United States Patent [19]

Hill

[11] 3,930,429

[45] Jan. 6, 1976

[54] DIGITAL MUSIC SYNTHESIZER

[75] Inventor: Jeremy R. Hill, Norfolk, Mass.

[73] Assignee: ARP Instruments, Inc., Newton, Mass.

[22] Filed: Apr. 26, 1974

[21] Appl. No.: 464,527

Related U.S. Application Data

[63] Continuation of Ser. No. 368,367, June 8, 1973, abandoned.

[52] U.S. Cl. ..... 84/1.01; 84/1.26; 84/1.19

[51] Int. Cl.[2] ..... G10H 1/00

[58] Field of Search ..... 84/1.01, 1.13, 1.26, 1.19, 84/DIG. 8, DIG. 7

[56] References Cited

UNITED STATES PATENTS

| | | | |
|---|---|---|---|
| 3,610,805 | 10/1971 | Watson et al. | 84/1.26 X |
| 3,708,603 | 1/1973 | Keagle et al. | 84/1.26 |
| 3,844,379 | 10/1974 | Tomisawa et al. | 84/1.26 X |

*Primary Examiner*—L. T. Hix
*Assistant Examiner*—U. Weldon

[57] ABSTRACT

The system of this invention is for use with an electronic musical instrument having a keyboard, and generally includes keyboard circuitry, audio waveform generators, envelope generators, static and dynamic filter circuitry and power amplifier and speaker apparatus. In accordance with one feature of this invention, the system comprises means for establishing different digital voice codes which are coupled to read only memories associated with the audio waveform generators, envelope generators and main voice circuitry. This voice code provides a limited number of program conditions to control such variables as audio waveform pulse widths, envelope attack, decay, sustain or release intervals, and instrument resonator control. Another feature of the present invention is concerned with the keyboard circuitry which operates from a digital key and octave code. Each code is sequentially interrrogated to determine if the corresponding key has been played. Although the completely illustrated embodiment is of a monophonic system, this sequential interrogation scheme lends itself quite readily to polyphonic operation. Still another feature of the invention resides in a novel digital controlled oscillator of the audio waveform generators that includes a feedback control loop and wherein the majority of the components of the oscillator only operate over a one octave range.

16 Claims, 12 Drawing Figures

110000
36
TO DELAY 52

61
6 STAGE
FREQUENCY
DIVIDER
6 BIT
MEMORY
6 BIT CODE
CHANGE
DETECTOR
56D
OCT 4 BUSS
56C
OCT 3 BUSS
56B
OCT 2 BUSS
56A
OCT 1 BUSS
56
OCTAVE
DECODER
f/64
f/32
+V
Q
Q̄
R
J Clo K
D
Clo
63
150
.01μf
A
B
OCTAVE
CODE
62
.01
60
f/16
f/8
f/4
f/2
26
C
D
E
F
KEY
CODE
TO DATA
SELECTOR f
34
FROM GATE
MEMORY 32

35

DIGITAL MUSIC SYNTHESIZER

RELATED APPLICATION

This is a continuation of application Ser. No. 368,367 filed June 8, 1973 now abandoned.

FIELD OF THE INVENTION

The present invention relates in general to electronic musical instruments of the keyboard-type. More particularly, this invention is concerned with an electronic music synthesizer or organ system that has digital control and is characterized by digital keyboard circuitry.

BACKGROUND OF THE INVENTION

Electronic music systems of the keyboard-type heretofore constructed have been primarily of the analog type in that most of the signals to be processed are analog signals. As a result it has been difficult to provide for the programming of certain operations such as the operation of the envelope generators.

Accordingly, it is an object of the present invention to provide an improved electronic musical system that is under digital control by means of a voice code that controls many variables and interconnections associated with the system. Regarding the envelope generators, for example, in the present invention memory means, preferably in the form of read only memories, are associated with the generators for controlling such variables as envelope wave-form attack and decay. The attack time constant, for example, is varied in dependence upon the selected voice code which in turn usually corresponds to the desired instrument voice.

Another object of this invention is to provide digital keyboard circuitry that is compatible with the digital voice code control of the system and that is characterized by a sequential interrogation scheme for determining which key is being played which is in turn represented by a predetermined key and octave code.

A further object of this invention is to provide improved keyboard circuitry for generating a key and octave code and which is readily adaptable for use in a polyphonic musical system.

Still another object of this invention is to provide an improved audio waveform generator comprising a digital controlled oscillator having components thereof that are required to operate only over a one octave range thereby providing improved operation consistent with the ability to apply variable portamento or glissento across several octaves (three octaves in illustrated case).

SUMMARY OF THE INVENTION

The present invention is directed to an electronic musical system having a keyboard and generally comprising keyboard circuitry, audio waveform generators, envelope generators, static and active filter circuitry, power amplifier and speaker apparatus, and voice code control means. In accordance with one aspect of the present invention there is provided means for establishing different digital voice codes which are coupled to memory means associated with the audio waveform generators, envelope generators and filtering circuitry. In the system there is provided means coupled to the keyboard and responsive to operation of at least one key of the keyboard for providing a signal of frequency corresponding to the key played, means responsive to the sustained playing of at least one key for providing an envelope control signal, means responsive to the frequency signal and the envelope control signal for generating a controlled audio signal, and code storage means coupled to both the frequency signal providing means and the envelope control signal providing means for controlling the characteristic of either the frequency signal or envelope control signal. The voice code provides a limited number of program conditions to control such variables as audio waveform pulse widths, envelope intervals and instrument resonator control.

Another aspect of the present invention is concerned with the keyboard circuitry which operates from a digital key and octave code. In accordance with this aspect of the invention the circuitry comprises switch means associated with each key of the keyboard, means for sequentially interrogating each switch means to determine if it is in a played condition, and means for sensing the occurrence of a played key. The means for sequentially interrogating includes means for generating a binary signal code with a different code being associated with each key. The circuitry also includes means responsive to the sensing means for storing the binary code corresponding to the played key. The circuitry may also include means for generating a gate signal which is at its enable level as long as at least one key is played, and a trigger signal of shorter duration and occurring at the commencement of the gate signal and possibly at other times during the gate signal if subsequent keys are played.

Still another aspect of the present invention resides in a novel digital controlled oscillator contained in the audio waveform generators. This oscillator includes a feedback control and is characterized by a majority of its components operating over only a one octave range. In one embodiment this digital controlled oscillator or digital to frequency converter circuit comprises a digital to analog converter, an analog comparator, an exponential converter, an oscillator, means for introducing both the octave and key codes to the circuit, and frequency to voltage converter means. The operation of this circuit and the advantages associated therewith are discussed in more detail hereinafter in the following detailed description.

DESCRIPION OF THE DRAWINGS

Numerous other objects, features and advantages of the invention will now become apparent upon a reading of the following detailed description taken in conjunction wit the accompanying drawings in which.

DETAILED DESCRIPTION

Figure 1:
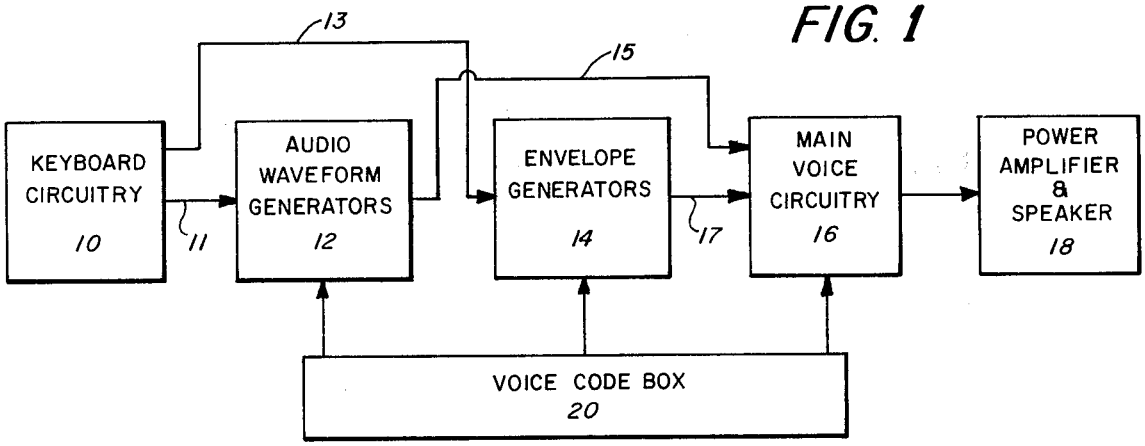
FIG. 1 is a general block diagram of an electronic music system of the present invention.

FIG. 1 is a general block diagram of a system of the present invention embodied in an electronic musical instrument or synthesizer. In FIG. 1 the keyboard circuitry 10 has a digital output code coupled on line 11 to audio waveform generators 12, and on line 13 to envelope generators 14. The lines 11 and 13, as shown hereinafter, are actually a plurality of conductors. The conductors of line 11 have binary signals coupled thereon.

The audio waveform generators 12 basically generate a sawtooth and/or pulse signal of proper frequency, shown in the block diagram of FIG. 1 as being coupled by way of line 15 to main voice circuitry 16. The envelope generators 14 may include an attack-release (AR) generator and an attack-decay-sustain-release (ADSR) generator, as discussed in more detail hereinafter. The signals received on line 13 from keyboard circuitry 10 control the wave-forms developed by generators 14. One or a combination of these waveforms are coupled by way of line 17 to main voice circuitry 16. The output of circuitry 16 couples to a conventional power amplifier and speaker apparatus 18.

Also shown in FIG. 1 is voice code box 20 which has separate lines coupling to generators 12, generators 14, and circuitry 16. Digital codes may be programmed into voice code box 20 for controlling the envelope waveform; controlling the envelope attenuation; octave and pulse width selection; and the selection of the proper instrument resonators which are contained in main voice circuitry 16. The codes may be set by means of switches. For example, the voice code box may be a Texas Instruments integrated circuit such as their type SN 54147. The lines coupling from box 20, in the disclosed embodiment, control read only memories (ROM's) contained within the generators 12 and 14, and circuitry 16.

Figure 2A:
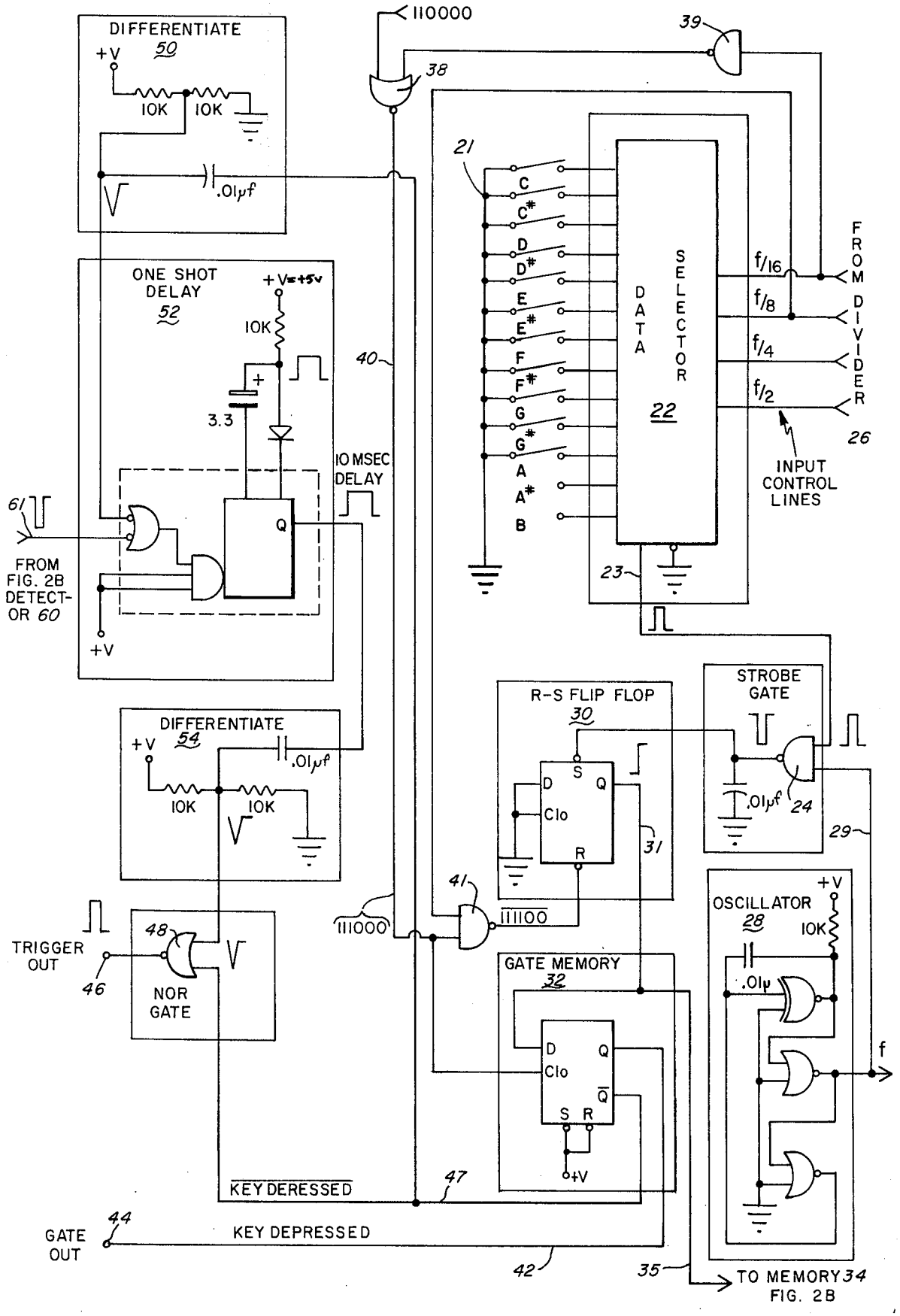
FIGS. 2A and 2B are logic circuit diagrams of a preferred embodiment of the keyboard circuitry of FIG. 1.
Figures 2A, 2B:
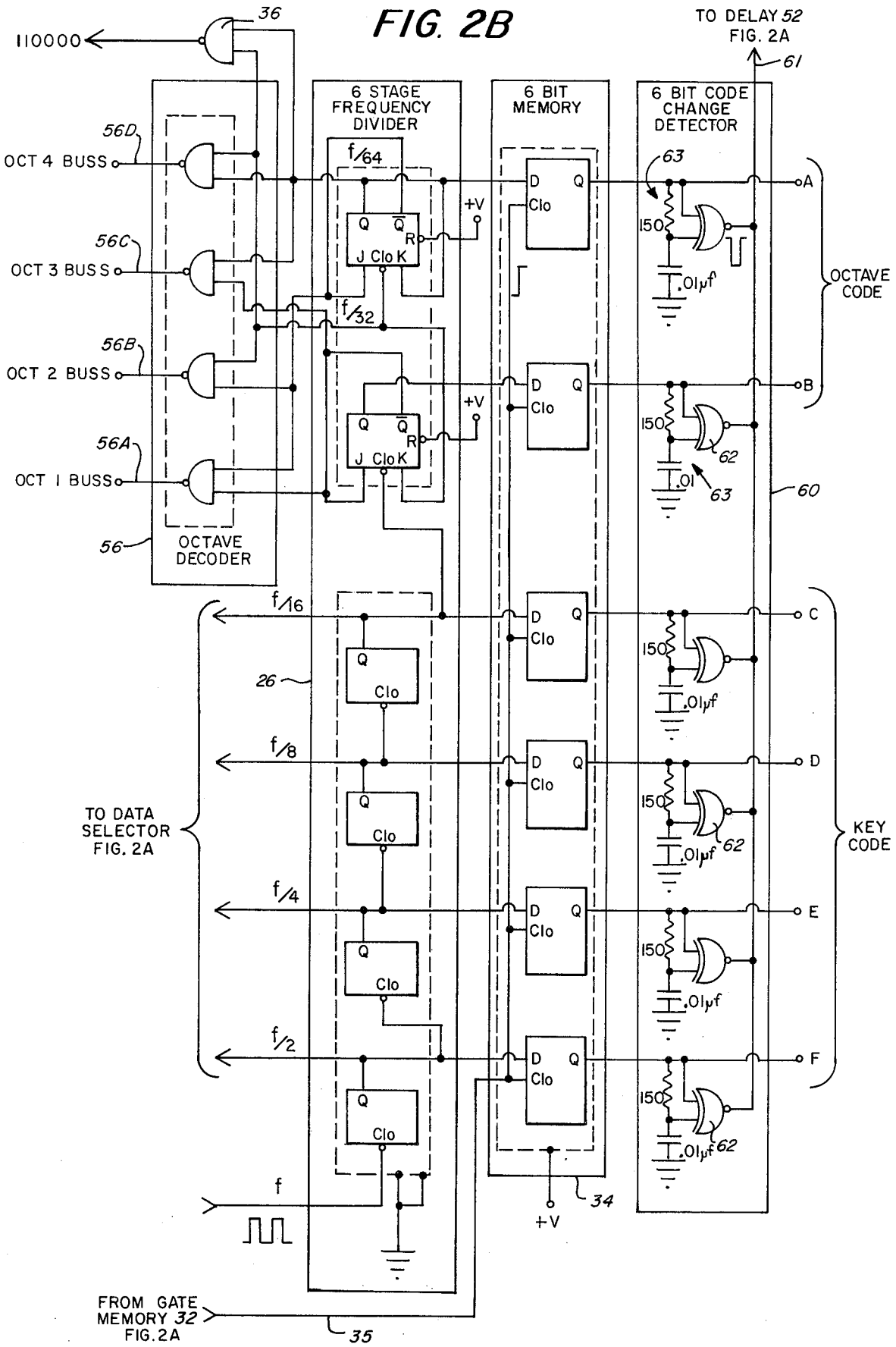

FIGS. 2A and 2B show a logic circuit diagram for the keyboard circuitry 10 shown in FIG. 1. Each of the inputs (C, C No., D, D No., . . . B) to the data selector may be considered as coupling to a key responsive switch 21 for providing a ground signal or other voltage level on the corresponding input of the data selector.

Referring now to FIGS. 2A, 2B, the data selector 22 has an output line 23 coupled to strobe gate 24. The data selector 22 also has four input control lines coupled from the first four stages of the six stage frequency divider 26. These four output stages are identified as stages N, M, L, and K. The divider 26 is constructed in the form of a conventional binary counter operated at a basic frequency *f* as determined by oscillator 28. Oscillator 28 may be considered as of conventional design and in one embodiment operates at a 100 kilohertz rate. This rate may be considered as basic frequency *f*. The frequency divided outputs *f*/2, *f*/4, *f*/8, and *f*/16, provide the four inputs K, L, M, N to the data selector 22. For example, the data selector may be a Texas Instruments integrated circuit such as their type SN 74,150 or SN 54,150.

If it is assumed that playing occurs only over one octave then it is only necessary at this point to discuss operation of the first four stages of divider 26. As the input binary codes to data selector 22 change, and assuming that only one key is depressed, then when the binary code corresponding to that key is reached an output pulse of positive polarity is generated on line 23. If more than two keys are depressed then the output pulse on line 23 first occurs at the lowest binary input number which normally corresponds to the lowest key depressed.

The data selector 22 is not shown in detail as it is considered to be of conventional design. In one embodiment the data selector 22 may comprise a plurality of AND gates each one of which would receive a possible signal from the key responsive switches, and each of which would also receive a different binary code. The selector 22 may also include an output OR circuit for passing the signal to output line 23.

When the positive output pulse occurs on line 23, and there is a concurrent positive pulse by way of line 29 from oscillator 28, then the output of NAND gate 24 reverts to a low level output, as shown, which is coupled to reset-set (R-S) flip-flop 30. This pulse sets flip-flop 30 and the signal on output line 31 of the flip-flop transitions to its positive level thereby enabling gate memory 32 of FIG. 2A and the six bit memory 34 of FIG. 2B which is discussed in more detail hereinafter. The operation of flip-flop 30 in effect locks out serial data after the lowest detected note. The positive signal on line 35 which is coupled to memory 34 immediately causes the binary code represented by the first four stages of divider 26 to be stored in the first four stages of memory 34. Thus, there has been stored a code which is representative of one of the keys of an octave that has been played.

Because the divider 26 is controlled from a continuously enabled oscillator 28, the divider 26 continues to count binary codes over those corresponding to the highest note of keyboard, and the outputs *f*/32 and *f*/64 can be decoded to provide clocking signals that occur after the key switches 21, have been sequentially interrogated.

At the binary count of 111000, as provided by gates 36, 38, and 39, a high voltage level occurs on line 40 which couples to the clock input of gate memory 32. If a key has been depressed the flip-flop 30 is set and thus upon the occurrence of the clock pulse the gate memory is set thereby indicating that a key has been depressed. As long as one key remains depressed the gate signal is sustained from the gate memory.

After the gate memory has been set the binary signal 111100 at the output of gate 41 provides a reset signal for flip-flop 30. Flip-flop 30 then requires another signal from data selector 22 in the next counting sequence in order to sustain the gate memory at its high output on line 42. This signal on line 42 is coupled to the gate output terminal 44. This signal is coupled to the envelope generators 14 which are discussed in more detail hereinafter.

FIG. 2A also shows the circuitry for generating the trigger pulse at terminal 46. When the gate memory 32 is set, a low level signal occurs on line 47 thereby enabling gate 48. Gate 48 will provide a positive output trigger pulse when both of its inputs are at a low level. The low level pulse to the other input of gate 48 can be provided from two sources, one being the setting of memory 32 and the other being from a change in the key code. The second mode of generating the trigger pulse will be discussed in more detail hereinafter with respect to the description of FIG. 2B.

When the gate memory 32 is set the voltage on line 47 which also couples to differentiate circuit 50 goes to its low level. Differentiate circuit 50 thereby has a negative output impulse that is coupled to one-shot delay circuit 52. Circuit 52 is of conventional design and is adapted to provide a delay on the order of ten milliseconds. FIG. 2A shows the output of circuit 52 which is coupled to differentiate circuit 54. Circuit 54 provides a negative impulse to gate 48. When this impulse is concurrent with a low signal on line 47 a trigger output is provided at terminal 46.

FIG. 2B shows the octave decoder 56 which receives coded signals from the last two, low frequency, stages of the divider 26. The output of the octave decoder includes in this embodiment four output lines 56A, 56B, 56C and 56D which couple to four separate busses shown in FIG. 9. Each bus ties in common one side of all the switches associated with one octave of the keyboard. The outputs of the octave decoder are enable signals for each of the separate busses.

As previously indicated, FIG. 2B includes the frequency divider 26 and memory 34. FIG. 2B also shows a six bit code change detector 60.

Assuming that one key is depressed in one of the octaves, the divider 26 counts until the code is reached corresponding to that key. At that time, an enabling signal is provided on line 35 to each of the stages of memory 34. This signal on line 35 is a clock signal for the memory which transfers the contents of divider 26 into memory 34. The output of the memory 34 couples to the detector 60 and also couples directly to the output terminals A and B (representing the octave code) and C, D, E and F (representing the key code).

With the system of this invention a trigger output is to be provided not only when the gate signal first appears but also at any time that a player changes from one key to another without releasing all keys. When this occurs the change detector 60 generates a negative pulse on line 61 which is coupled to circuit 52 for operating circuit 52, differentiator 54 and gate 48 in a manner previously discussed with reference to the circuitry of FIG. 2A.

The detector 60 comprises six exclusive OR gates 62 which each function as a comparator. Detector 60 also includes a plurality of delay circuits 63 which couple to one of the inputs of the gates 62. If the inputs to any one of the gates 62 differ then there will be a low level pulse on the output line 61. This will occur at at least one of the gates when the code changes and in effect, the new code appears on one of the inputs and the old code, which is delayed, still is maintained on the other of the inputs.

Thus, in FIGS. 2A and 2B there has been shown circuitry for generating the GATE and TRIGGER signals, inputs from the keyboard including key contact inputs and bus inputs, and key and octave code outputs which are continuously updated.

Figure 3A:
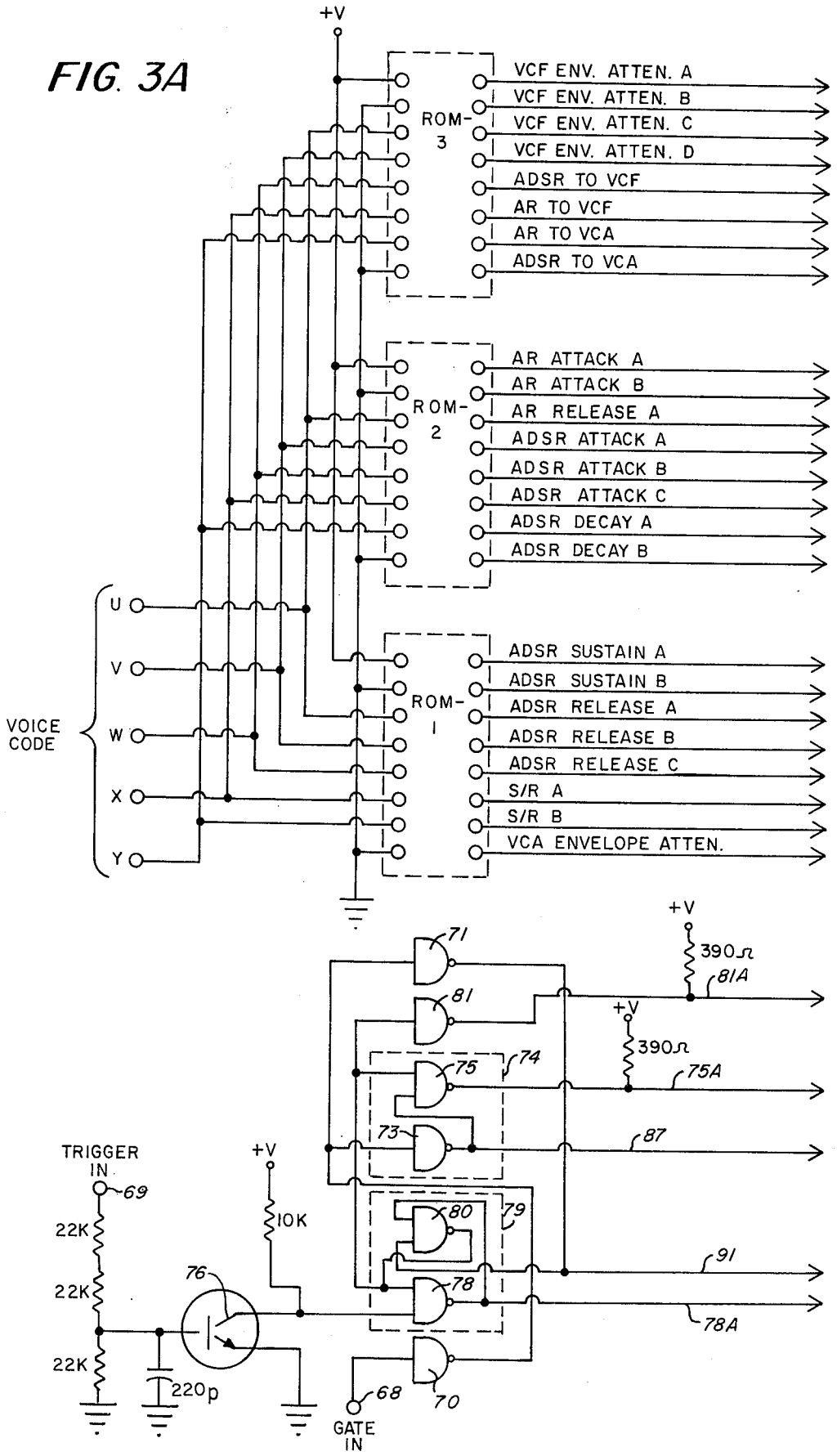
FIGS. 3A and 3B are logic circuit diagrams of the envelope generators of FIG. 1.
Figure 3B:
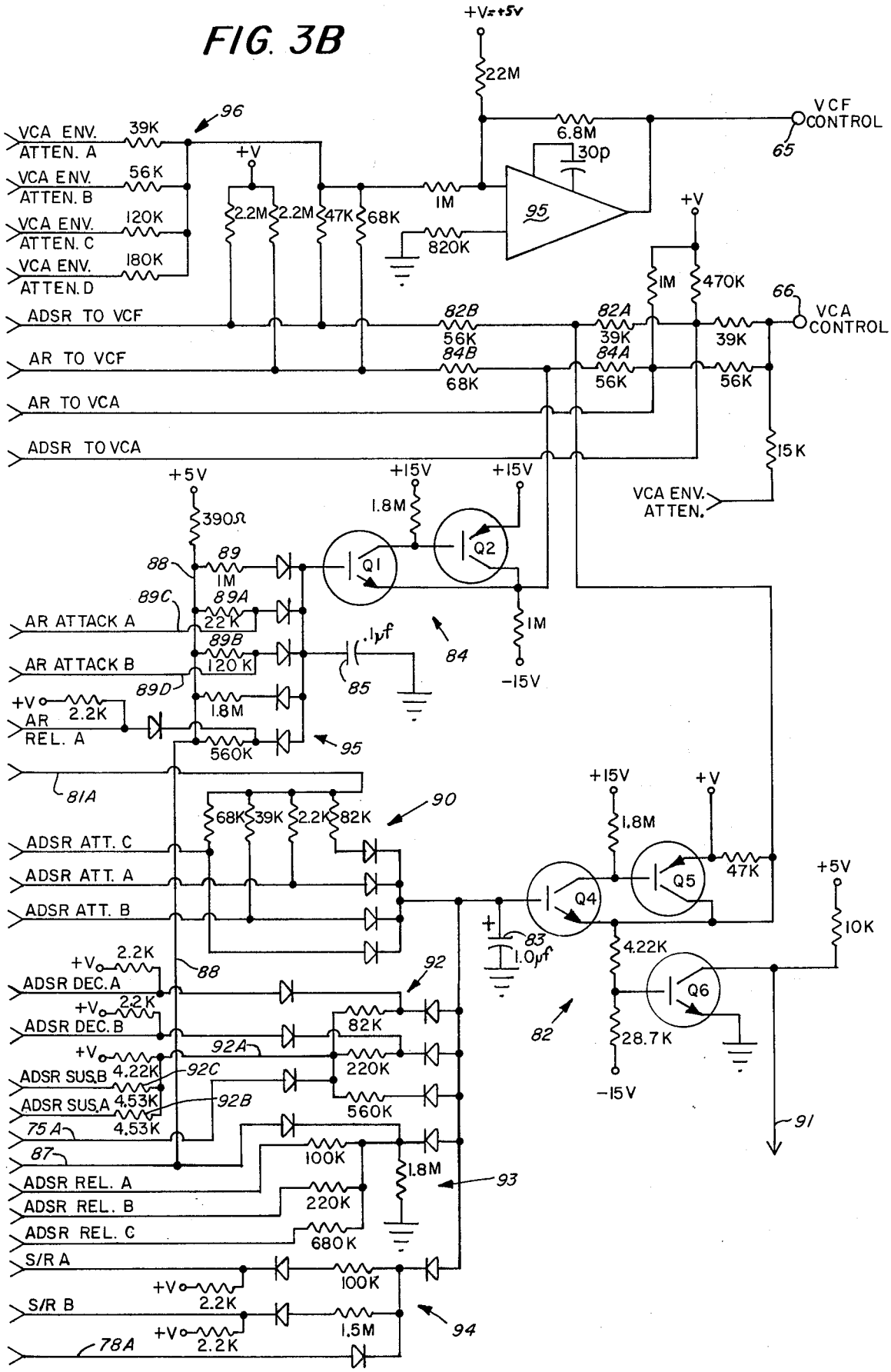

FIGS. 3A and 3B show the envelope generators 14 depicted in FIG. 1. The envelope generators are controlled primarily from the trigger and gate signals received from the keyboard circuitry, and are also controlled from a voice code of five bits coupled from box 20 of FIG. 1. The envelope generators provide two basic outputs, one at terminal 65 which couples to the voltage control filter of circuitry 16 and one at terminal 66 which couples to the voltage control amplifier also shown in the circuity 16 which is discussed hereinafter in more detail.

The use of a programmable voice code is one of the important features of the present invention. Regarding the use of the voice code in association with the envelope generators, different predetermined codes can be used for controlling, for example, attack, decay, sustain, and release time intervals in dependence upon the particular instrument being simulated. For example, if the instrument is a harpsichord the envelope has a faster attack time constant than if the instrument were a horn.

In FIG. 3A the voice code is coupled on lines U, V, W, X and Y to the read only memories ROM-1, ROM-2, and ROM-3. The five bit inputs to these ROMS, and other ROMS discussed hereinafter, provide up to a total of 32 different voice combinations. ROM-2, for example, might have a code set therein desiring an attack A for AR generator 84. This would mean that the first line of ROM-2 would be permitted to float but the second line would be grounded thereby preventing an AR attack B. Further discussion of the control provided by these read only memories will be discussed hereinafter with reference to other parts of the circuitry shown in FIGS. 3A and 3B.

The gate and trigger signals developed in the circuitry of FIG. 2A are coupled, respectively, to terminals 68 and 69 of FIG. 3A. The gate signal which is positive during the time interval that any key is depressed, is coupled by way of inverter gate 70 to inverter gate 71 and inverter gate 73.

The trigger input at terminal 69 couples by way of inverting transistor 76 to gate 78 which comprises one gate of flip-flop 79, the other gate being gate 80. The logic gates shown in FIG. 3A are responsive to the gate and trigger signals from the keyboard circuitry for controlling the initiation of the attack, decay and release segments of the envelope waveforms from generators 82 and 84.

The envelope generators basically include an ADSR generator 82 and an AR generator 84. The generator 82 has an integrating capacitor 83 associated therewith and generator 84 has a similarly placed capacitor 85 associated therewith.

As previously mentioned, when a key is depressed the gate signal at terminal 68 goes positive. This signal is inverted by gate 70 and gate 73 to provide a high level enabling signal on line 87. This signal is coupled to tie line 88 associated with generator 84 of FIG. 3B providing a charge path through at least resistor 89 to capacitor 85 for causing an exponential increase in voltage at the base of transistor Q1 of generator 84. If ROM-2 has a binary code indicating that charge paths should also be provided through resistors 89A and 89B then the signals on lines 89C and 89D are floating. If either of these lines are grounded then the charging time cost is altered. In this way the initial attack time constant can be controlled, different instruments requiring a longer or shorter attack interval.

When the gate signal goes high, the flip-flop 79 is set from the trigger signal, line 81A is also high thereby providing a charging current to attack timing circuit 90 of generator 82, which receives three inputs from ROM-2 and includes intercoupled resistors and diodes, as shown. Again, depending upon which of the lines coupled from ROM-2 is grounded, there can be different charge paths for capacitor 83. The end of the attack interval is sensed by transistor Q6 associated with generator 82. The base of transistor Q6 is biased by resistors that couple to the output of generator 82. As the attack envelope increases a voltage is reached at the base of transistor Q6 which is sufficiently positive to render that transistor conductive. The voltage on line 91 is at its low level then and flip-flop 79 resets. When flip-flop 79 is reset a low-level signal is provided on line 75A by way of gate 75 thereby permitting the decay circuit 92 to come into operation. The capacitor 83 can then discharge through circuit 92 at a time constant depending upon the code of ROM-2.

It is noted that circuit 92 also connects by way of line 92A to sustain resistors 92B and 92C which in turn couple to ROM-1. By the proper code selection, line 92A can be maintained at different sustain voltage levels. When the selected sustained level has been reached capacitor 83 is maintained at that voltage level.

At a later point in time the gate signal on terminal 68 terminates thereby providing a ground signal on line 87 which permits the release circuit 93 to come into operation. Capacitor 83 is then allowed to discharge toward ground at a time constant determined by circuit 92 and the code of ROM-1.

The sustain/release circuit 94 which is also controlled from ROM-1 provides another programming function for similar to the line release function for causing discharge of capacitor 83. Line 78A from flip-flop 79 controls circuit 94.

Line 87 also couples by way of line 88 to release circuit 95 associated with envelope generator 84 for controlling the discharge of capacitor 85.

The output of generator 82 is coupled by way of resistor 82A to the VCA control terminal 66. Similarly, the output of generator 84 is coupled by way of resistor 84A to the VCA control terminal 66. Resistors 82A and 84A along with other resistors coupled thereto from a combining circuit wherein either or both of the waveforms from generators 82 and 84 may be coupled to terminal 66.

Similarly, the outputs of envelope generators 82 and 84 couple by way of resistors 82B and 84B to operational amplifier 95. The output of the operational amplifier couples to terminal 65 which is the terminal that controls the voltage controlled filter discussed hereinafter.

ROM-3 is used to control the coupling of the AR and ADSR signals to either or both of the output terminals 65 and 66. Four of the output lines of ROM-3 are provided for that function. The other four output lines of ROM-3 are used for providing different levels of attenuation of the envelope signals coupled to amplifier 95. There is provided an attentuation circuit 96 which includes four resistors of different predetermined value each coupling from one of the four envelope attentuation controlling outputs of ROM-3. Depending upon which of these resistors are permitted to be grounded there will be provided different levels of attenuation of the signals fed from the envelope generators to amplifier 95.

One of the blocks of FIG. 1 shows the audio waveform generators which are controlled by the key and octave codes and the voice select code. The audio waveform generators basically provide a sawtooth waveform and a pulse waveform of variable pulse width. The output of the audio waveform generators couples to the main voice circuitry 16.

Figure 4:
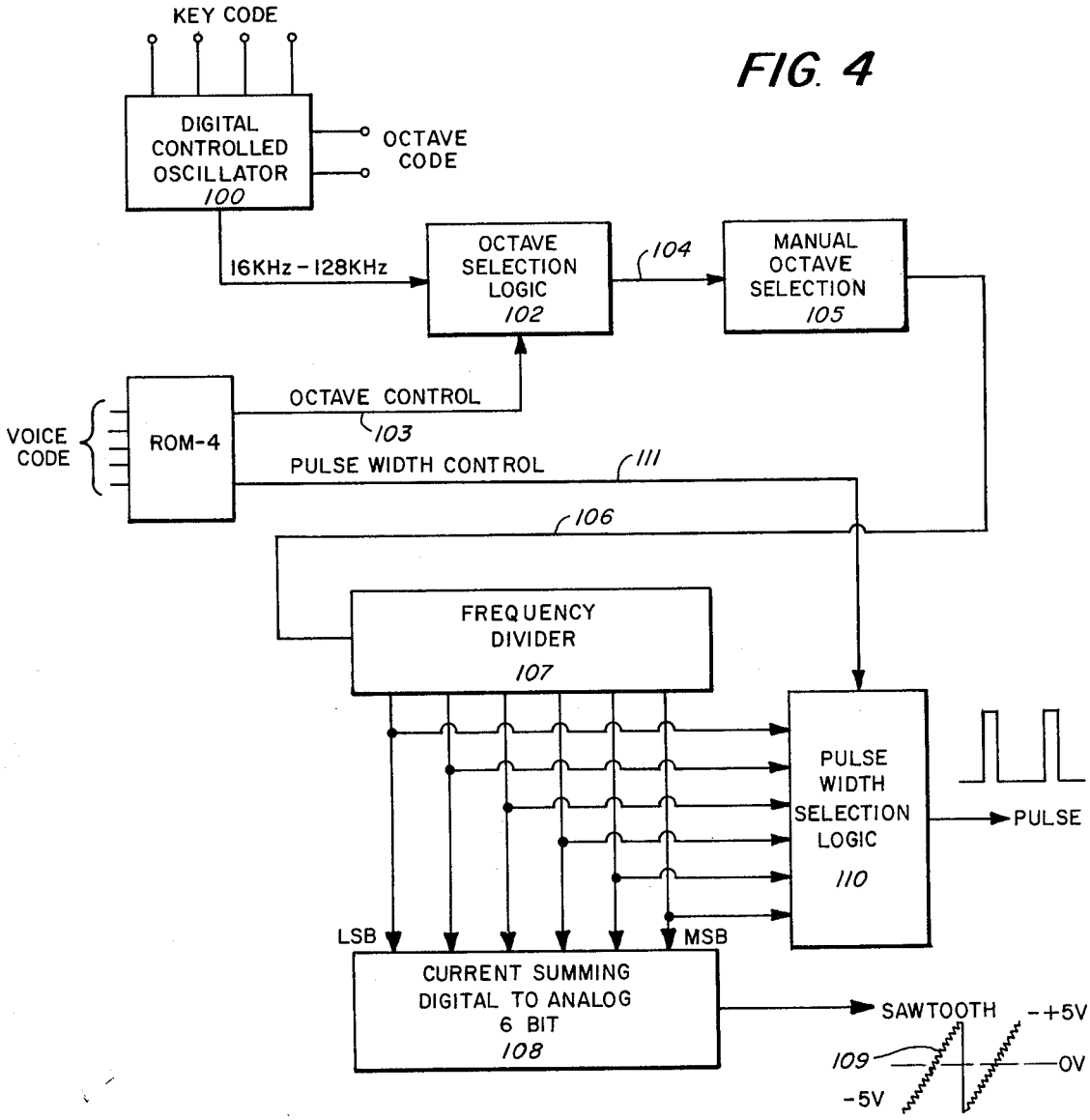
FIG. 4 is a block diagram of the audio waveform generators shown in FIG. 1.
Figure 5:
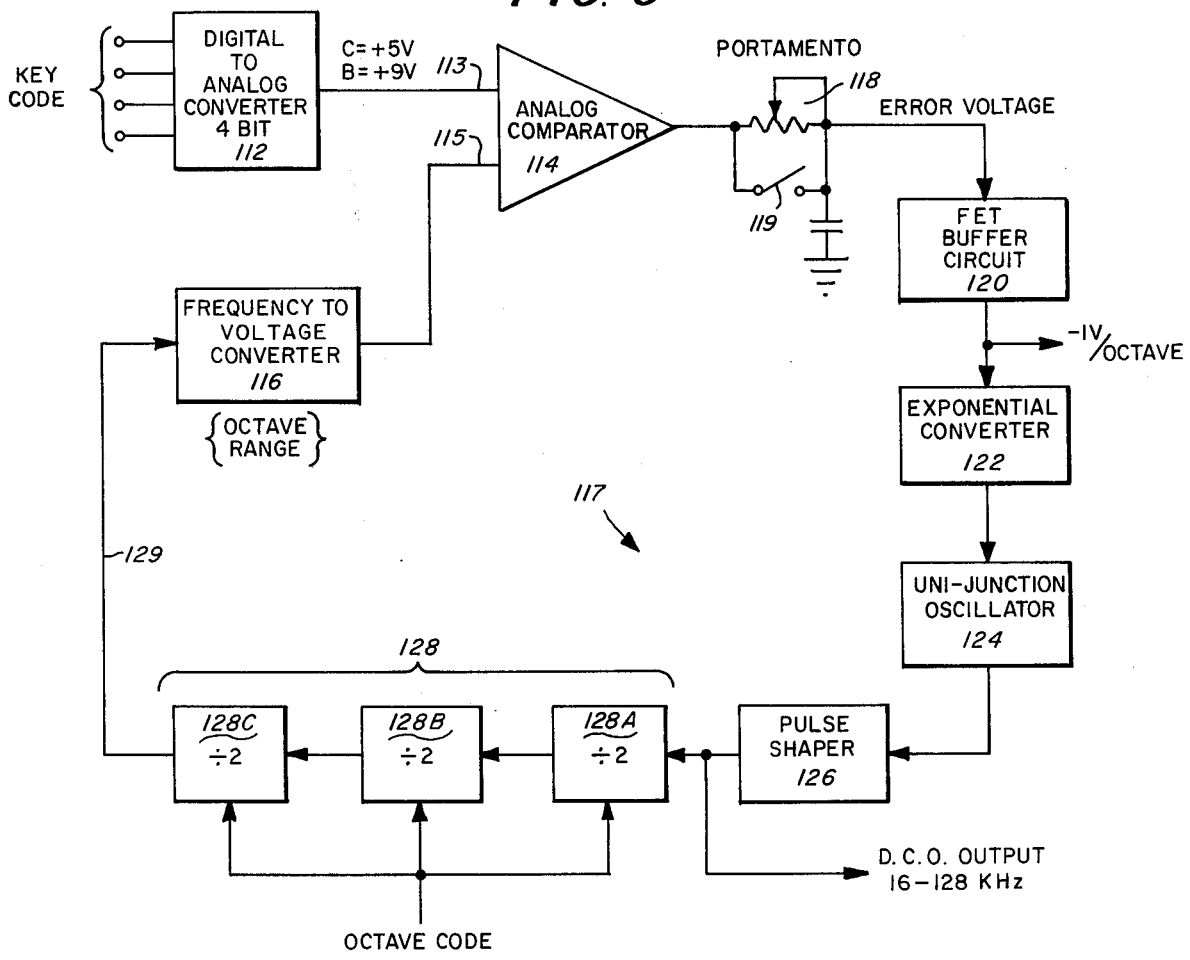
FIG. 5 is a block diagram of the digital controlled oscillator depicted in FIG. 4.
Figure 6A:
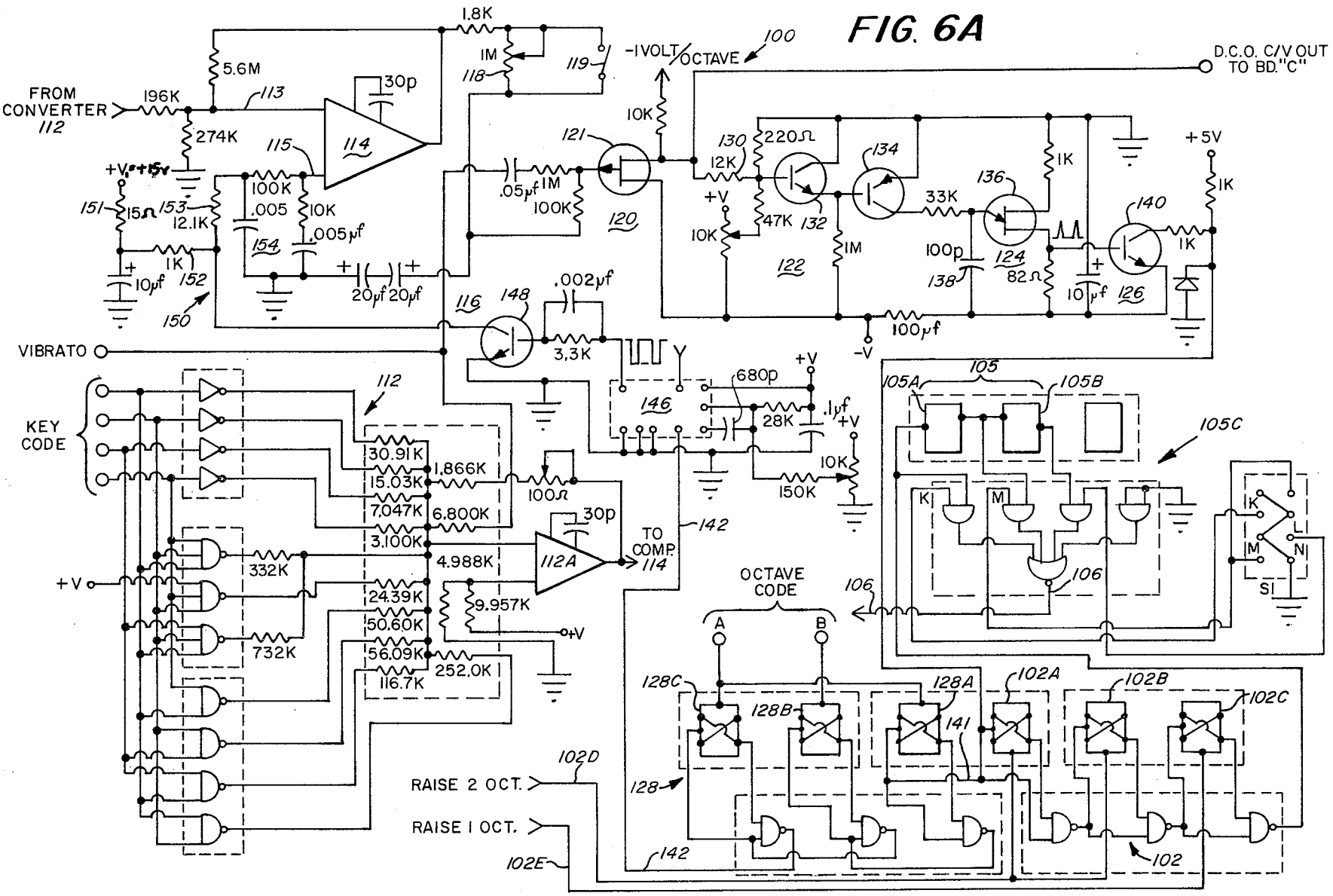
FIG. 6A and 6B are circuit logic diagrams showing in detail an implementation for the audio waveform generators shown in the block diagram of FIG. 4.
Figure 6B:
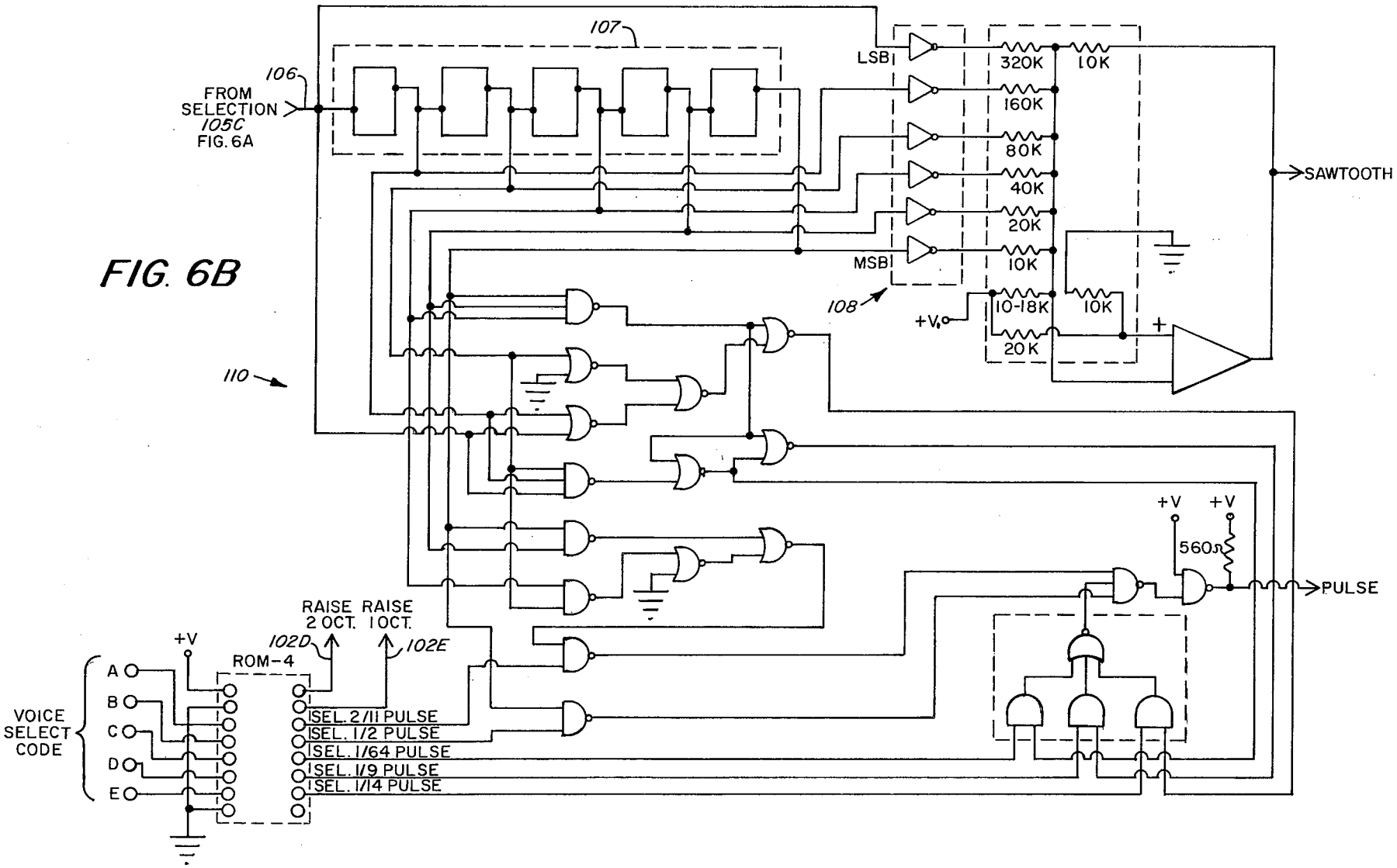

FIG. 4 shows a block diagram for a preferred embodiment of the audio waveform generators 12 shown in FIG. 1. FIG. 5 is a block diagram showing further detail of the digital-controlled oscillator depicted in FIG. 4. FIGS. 6A and 6B show an actual circuit and logic implementation for the audio waveform generators.

In FIG. 4 the digital-controlled oscillator 100 receives the key code and octave code binary signals from the keyboard circuitry of FIG. 2. Oscillator 100 may typically have an output frequency range from 16KHz to 128KHz. The output frequency at any one time is, of course, a function of the key and octave codes. The output of oscillator 100 couples to octave selection logic 102 which also receives an output by way of line 103 from ROM-4. Actually, line 103 may comprise two separate conductor lines for altering the output of oscillator 100 by either one or two octaves. For example, if the output of oscillator 100 is a signal of 32KHz rate then logic 102 may change the frequency to 16KHz.

The output of octave selection logic 102 couples by way of line 104 to manual octave selection box 105. Box 105 may comprise a manually operated switch, as disclosed hereinafter with reference to FIG. 6A, for manually raising or lowering by one octave. The output of box 105 couples by way of line 106 to the frequency divider 107. The divider 107 may be a binary counter with its left-most output being the least significant bit (LSB) and its right-most output being the most significant bit (MSB). In the embodiment disclosed in FIG. 4 there are six separate outputs from divider 107 which couple to the digital to analog summer 108 and the pulse width selection logic 110. The continuously counting divider or counter 107 has its output summed by summer 108 and there is provided at the output of summer 108 a waveform 109 as shown in FIG. 4. This is a stepped sawtoothed waveform as indicated which typically rises between minus five volts and plus five volts. When the counter 107 terminates its count and reverts to a zero count the waveform transitions to its −5 volt level.

The six output lines from divider 107 also couple to logic 110. Logic 110 also receives an input from ROM-4 by way of line 111. Actually, line 111 may comprise a plurality of conductors for controlling the pulse width selection logic 110. The width of the PULSE output is a function of the control coupled by way of line 111 to logic 110. Logic 110 is shown in more detail hereinafter in FIG. 6B.

FIG. 5 is a block diagram of the digital-controlled oscillator 100 of FIG. 5. In accordance with one aspect of the present invention there is provided an improved oscillator 100. Unlike most prior art devices which were required to operate over many octaves of frequency, the oscillator of this invention has most of its circuitry operating only over a one octave range thereby making the oscillator more stable and easier to construct and operate.

FIG. 5 shows the digital to analog converter 112 which receives the four bit key code and converts this code, independently of the octave code, into an analog voltage range of four volts. As indicated in FIG. 5 the note C is designated by a plus five volt level and the note B above that note C is designated by a plus 9 volt level.

The output of converter 112 is fed to the input 113 of analog comparator 114. The other input 115 to comparator 114 couples from a stable frequency to voltage converter 116 which operates over a one octave range. If the key code is assumed to be constant then the loop including converter 116 tends to maintain the two inputs to comparator 114 at the same voltage. Under that condition the high gain comparator provides an error signal and the output of the circuit shown in FIG. 5 is maintained at the proper frequency corresponding to the key code coupled to converter 112.

The loop 117 may be considered as comprising all of the blocks or circuitry from the output of comparator 114 around to the output of converter 116. The output of analog comparator 114 couples to portamento potentiometer 118. A portamento control is typical in electronic musical synthesizers and in FIG. 5 includes a switch 119 for disabling the portamento when the switch is in its closed position. When the switch is in its open position as shown the output of analog comparator 114 is delayed thereby causing a slurring or portamento effect due to an increase in the loop correction time. In FIG. 5 the output from the portamento control to the FET (field effect transistor) buffer circuit 120 is termed an error voltage.

The output of circuit 120 provides a −1 volt/octave signal which is used as a control signal for tracking the voltage controlled filters in the main voice circuitry 16, and which also couples to the exponential converter 122 shown in FIG. 5. The converter 122 may be of conventional design and provides an exponential output in accordance with the −1 volt/octave input signal. A typical converter 122 that may be employed is of the type shown in U.S. Pat. No. 3,444,362.

The output of converter 122 couples to and controls the operation of oscillator 124. This oscillator is a uni-junction oscillator that may also be of conventional design. The output of oscillator 124 couples to pulse shaper 126 which may be of conventional design. The output of the pulse shaper 126 is the digital control oscillator output which typically varies from 16KHz to 128KHz, this frequency range being representative of three complete octaves of frequency. This range corresponds to that of the keyboard being used to control the instrument.

The output of shaper 126 couples to divider group 128 which in FIG. 5 includes three blocks 128A, 128B and 128C, each of which can provide a ÷2. The divider string is controlled by the two bit octave code from the keyboard circuitry and the output of the divider string couples by way of frequency to voltage converter 116.

As previously indicated, when the key code is maintained at a predetermined binary code because a new key has not been played, the error voltage fed to circuit 120 is small and the output of the circuit of FIG. 5 is operating at a frequency corresponding to the key code.

Suppose that the key code at one time corresponds to low C. If C one octave higher is played then the output of divider 128 changes in frequency and the converter 116 causes an unbalance at the input of comparator 114. This causes an error voltage of predetermined polarity which in turn causes oscillator 124 to operate at a different frequency. The output of shaper circuit 126 thus seeks the proper frequency and when the proper frequency is coupled by way of lines 129 to converter 116 comparator 114 is in balance and the error voltage again becomes small. The loop is then stabilized. At that point, the output of the circuit of FIG. 5 is operating at twice its original frequency.

Assuming that the change in code is not from one octave to the next, but is instead from one key to the next, then the same type of operation occurs. In this case, the voltage on line 113 changes immediately with a change in the key code causing an unbalance at the input to comparator 114. This error voltage is fed back to change the output of the oscillator 100 and eventually to stabilize the loop at this new output frequency.

For a more thorough understanding of the operation of the blocks shown in FIGS. 4 and 5 reference is now made to the circuit and logic diagram of FIGS. 6A and 6B. With reference to FIG. 4, FIG. 6A shows the digital controlled oscillator 100, octave selection logic 102 and manual selection 105. FIG. 6B shows the pulse width selection logic and the current summing digital to analog converter 108. FIG. 6A shows a conventional circuit and logic implementation for the digital to analog converter 112. The output at amplifier 112A of the converter is a voltage level signal representative of the key code input to the converter. This signal is coupled to input 113 of the comparator 114. The output of comparator 114 couples to portamento potentiometer 118.

Both FIGS. 5 and 6A show the portamento switch 119 coupled across portamento potentiometer 118. The other side of potentiometer 118 couples to field effect transistor (FET) buffer circuit 120 which includes field effect transistor 121 and associated biasing resistors. The output electrode of transistor 121 couples by way of resistor 130 to transistor 132 which comprises one of the transistors of exponential converter 122. The other transistor is transistor 134. Transistors 132 and 134 are thermally matched transistors and may be arranged as shown in FIG. 6A or as described in U.S. Pat. No. 3,444,362 for providing an output current at the collector of transistor 134 which is exponentially related to the voltage coupled by way of resistor 130 from circuit 120. The output of conveter 122, taken at the collector of transistor, 134 couples to uni-junction oscillator 124 which comprises uni-junction transistor 136 and charging capacitor 138. Uni-junction oscillator 124 is a conventional relaxation oscillator.

The output frequency of this oscillator is a function of the charging time of capacitor 138 which is in turn a function of the collector current of transistor 134 of converter 122.

The output pulses from the oscillator are fed to the base of transistor 140 which comprises the pulse shaper circuit 126. The frequency signal taken from the collector of transistor 140 may be termed, and is so termed in FIG. 5, as the digital controlled oscillator output signal. As indicated in FIG. 4 this signal is coupled to the octave selection logic 102 which is also shown in FIG. 6A, and also couples by way of line 141 to the divider string 128. The logic 102 includes three bistable devices 102A, 102B and 102C. Divider string 128 includes similarly arranged bistable devices 128A, 128B and 128C. Each of the bistable devices has a NAND gate associated therewith.

The two bit octave code couples to the reset inputs of bistable devices 128A, 128B and 128C. The output of bistable device 128C, coupled by way of its associated gate, is connected by way of line 142 to the frequency to voltage converter 116. Converter 116 converts the frequency signal on line 142 into a corresponding voltage which is coupled to input 115 of analog comparator 114.

The converter 116 includes a stable one-shot or monostable multivibrator 146, buffer transistor 148, and amplitude setting circuit 150. The one-shot 146 is adjustable to provide a fixed pulse width output which is coupled by way of transistor 148 to circuit 150. This pulse width adjustment serves as a fine tuning control for the overall digital oscillator system.

Transistor 148 and circuit 150 together control the amplitude of the pulse. Transistor 148 is non-conducting during the pulse width and the amplitude is controlled primarily by the nominally +15V supply. Circuit 150 also includes a lag-lead network circuit 154 which couples to the input 115 of comparator 114. This circuit provides for integration of the pulse train resulting in a d.c. voltage at the output of converter 116 as well as optimising overall oscillator loop for minimum response time consistent with loop stability.

As previously mentioned, the oscillator 100 includes the feedback arrangement that permits stable operation. When a code change occurs the comparator 114 generates an error voltage which is coupled to the FET buffer and converter 122. The oscillator adjusts its output frequency rapidly until the feedback signal to input 115 balances with the input signal at 113. With such an arrangement the converter 116 operates only over a one octave range.

Regarding the octave selection logic, control is provided from ROM-4 by way of lines 102D and 102E. Logic 102 is a frequency divider controlled by the levels on lines 102D and 102E, to provide 1 and 2 octave range changes. This divider arrangement is conventional logic design.

FIG. 6B shows the ROM-4 which receives the five bit voice code, frequency divider 107, digital to analog summer 108, and pulse width selection logic 110. The output of the octave selection logic 102, as previously indicated in FIG. 4, couples by way of line 104 to the manual octave selection box 105 which comprises two bistable dividers 105A and 105B shown in FIG. 6A. This box also includes a manual switch 105C which has three positions. In the first position there is no divider provided by selection box 105, in the second position there is a one octave decrease and in the third position there is a two octave decrease. The output from selection box 105 is coupled, as previously indicated in FIG. 4 by way of line 106 to frequency divider 107. FIG. 6B shows the six output lines from divider 107 which couple to the digital to analog summer 108.

The divider 107 includes five bistable devices and is a conventional frequency divider or binary counter. The summer 108 may also be of conventional design and adds in an analog fashion the counts from divider 107. When the count reverts to zero then the summer output goes to a minimum value as indicated in waveform 109 of FIG. 4.

The lines from divider 107 also couple to the pulse width selection logic 110. The pulse width selection logic 110 may be in many different forms depending upon the desired output pulse widths. In FIG. 6B the ROM-4 has the capability of selecting five different pulse widths. These lines from ROM-4 couple to different ones of the gates of logic 110 for providing different pulse widths. The logic 110 is considered of conventional design well within the expertise of one skilled in the art. The output of the selection logic 110 is termed the PULSE output as previously shown in FIG. 4.

In FIG. 1 the main voice circuitry 16 is shown as having inputs from generators 12, generators 14, and voice code box 20. The line 15 shown in FIG. 1 may actually physically comprise the pulse and sawtooth waveforms developed in generators 12. The line 17 coupling from the envelope generators may actually physically comprise control voltage signals for filters and amplifiers shown in circuitry 16. The connection from the voice code box to circuitry 16 is a five wire line for programming certain functions performed by circuitry 16 and discussed hereinafter with reference to FIGS. 7, 8A and 8B.

Figure 7:
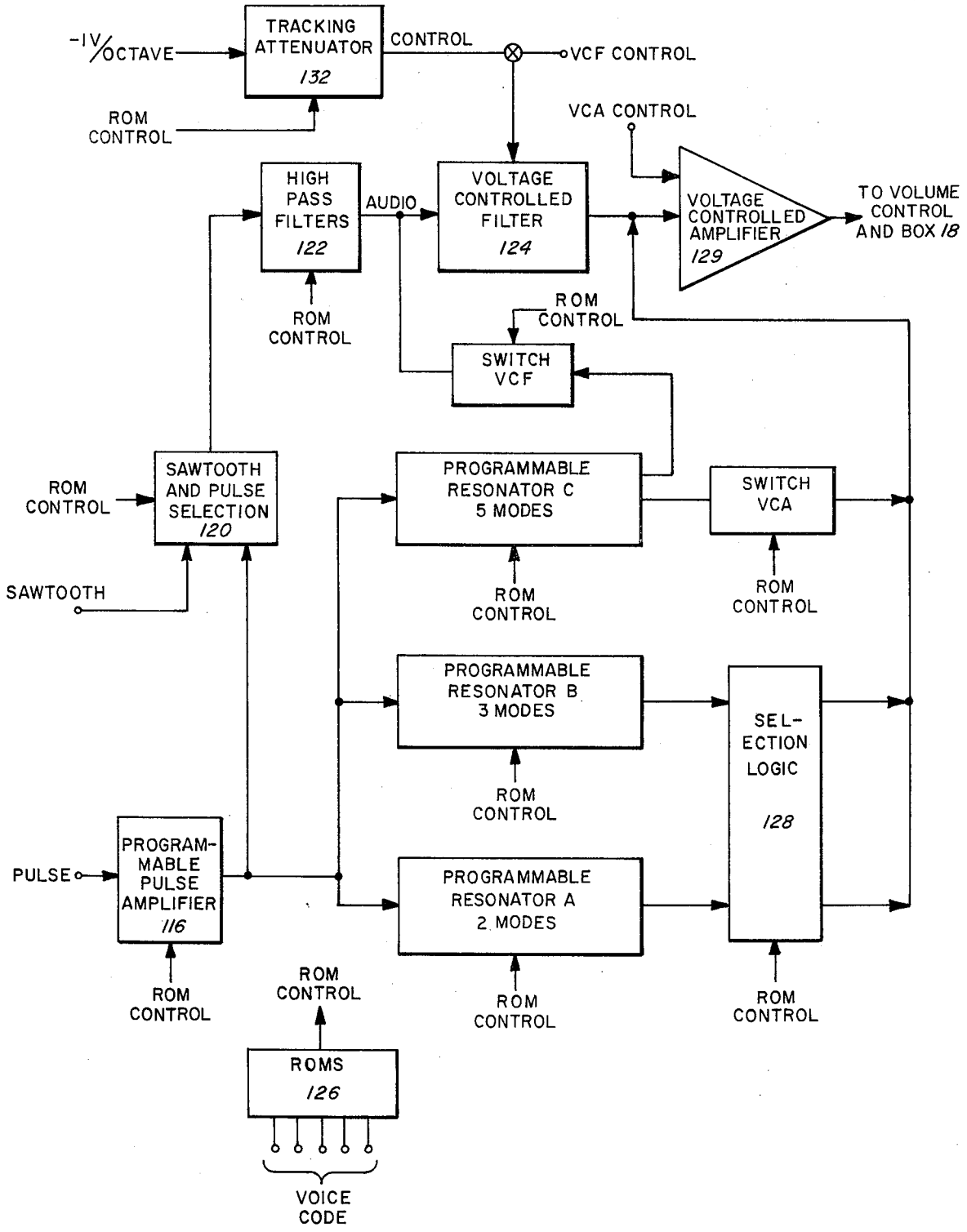
FIG. 7 is a block diagram of the main voice circuitry shown in FIG. 1.

The main voice circuitry 16 is shown in a block diagram in FIG. 7. In FIG. 7 many of the blocks have an input designated as ROM control. In the circuit embodiment shown hereinafter in FIGS. 8A and 8B there are employed three read only memories.

For the purposes of discussion at this time only a single ROM control input is shown in the block diagram of FIG. 7. Actually, the inputs from the ROM's to some of the blocks shown in FIG. 7 may comprise more than one conductive wire.

FIG. 7 shows the sawtooth and pulse signals coupled from the audio waveform generators 12. The pulse signal couples to programmable pulse amplifier 116 which has another input designated as the ROM control input. This input controls the output amplitude of the pusle. The output of amplifier 16 couples to programmable resonators A, B and C, and also to sawtooth and pulse selection 120. The sawtooth waveform also couples to box 120. The sawtooth and pulse selection is under ROM control as indicated in FIG. 7. Box 120 is provided for passing either the sawtooth or the pulse waveforms or combinations thereof to the high pass filters 122. The filters 122 comprise a plurality of separate filter circuits which may be selectively enables under ROM control to provide different filter characteristics. The output of filters 122 couples to the audio input of voltage control filter 124.

The pulse signal which is coupled by way of amplifier 116 is also coupled to programmable resonators A, B and C. Each of the resonators is structurally similar and includes a band-pass filter circuit. There are ROM control signals coupled to each of the resonators from ROM box 126. The ROM control is used to control the pass band and center frequency of the filter in dependence upon the preselected voice code. The output of resonators A and B couple to selection logic 128 which is of conventional design and comprises a plurality of logic gates for selectively passing the outputs from either or both of the resonators A and B.

The output of resonator C couples to switch VCA and also to switch VCF. Both of these switches are under ROM control and the output of resonator C can be selectively coupled to either the voltage controlled filter 124 or the voltage controlled amplifier 129, or both of these devices.

The voltage controlled amplifier 129 also includes a control input designated as the VCA control which coupled from the envelope generators of FIG. 3B. Similarly, the voltage controlled filter 124 receives a control signal from the envelope generator circuitry which is combined with a control signal from tracking attenuator 132. This attenuator is also under ROM control and receives the −1 volt/octave signal from the circuitry of FIG. 6A.

The VCF 124 may be of the type shown in U.S. Pat. No. 3,475,623. As is common in voltage controlled filters there is provided a control input and also an audio input. The resonance input is provided in accordance with the teachings of the aforementioned U.S. Pat. No. 3,475,623.

Figure 8A:
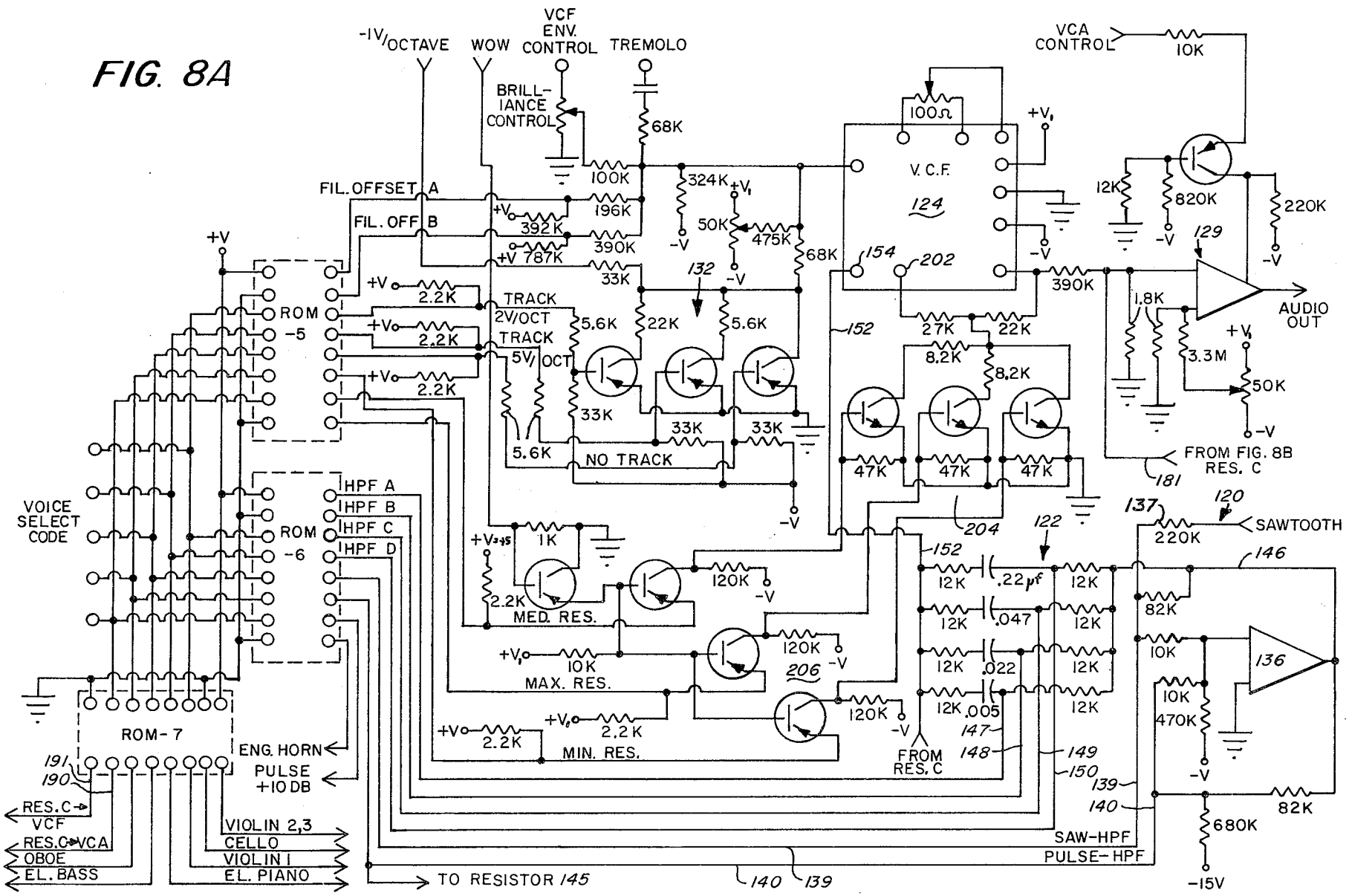
FIGS. 8A and 8B are logic circuit diagrams showing in detail one implementation for the main voice circuitry shown in the block diagram of FIG. 7.
Figure 8B:
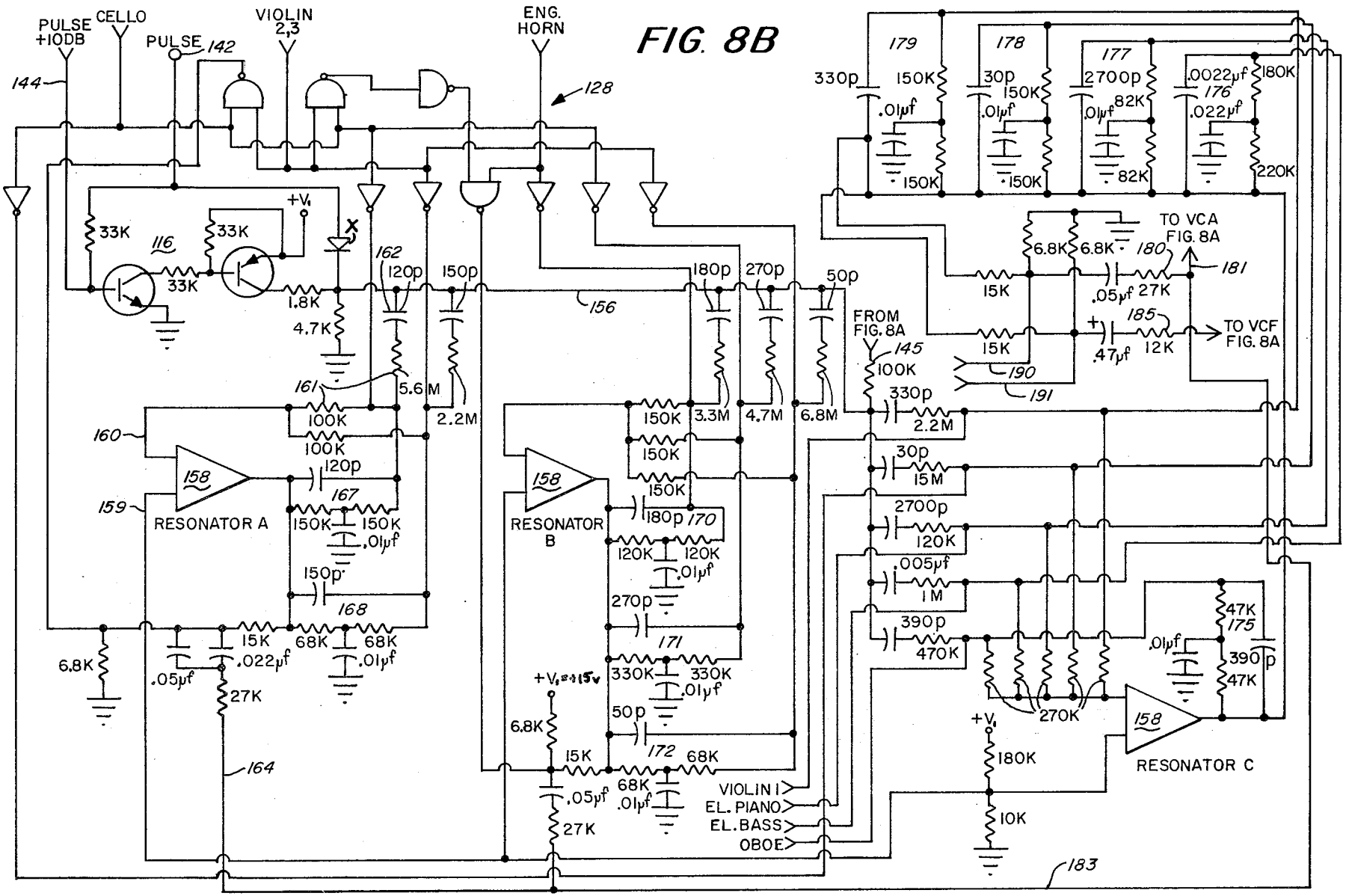

FIGS. 8A and 8B show a circuit and logic diagram of the main voice circuitry. FIG. 8A shows three read only memories which are designated as ROM-5, ROM-6 and ROM-7. The voice code from box 20 is coupled to the input of the read only memories for controlling the outputs thereof. The operation of these read only memories is discussed in more detail hereinafter with reference to the functioning of other parts of the circuitry shown in FIGS. 8A and 8B. As discussed with reference to FIG. 7, the sawtooth waveform is coupled to sawtooth and pulse selection box 120 which, in FIG. 8A, comprises a combining circuit including summer 136. Summer 136 has the sawtooth waveform coupled thereto by way of resistor 137, and has the pulse waveform coupled thereto by way of resistor 145.

The control for the coupling of the sawtooth and pulse waveforms to summer 136 is by way of lines 139 and 140 which couple, respectively, to resistors 137 and 145.

For predetermined voice codes the ROM-6 may provide a ground signal on either of the line 139 or 140 or both of these lines. A ground signal will shunt either the sawtooth or pulse signals and prevent them from reaching summer 136.

The pulse waveform which is coupled to summer 136 may be an amplified pulse waveform that has passed from the pulse input terminal 142 (FIG. 8B) to programmable pulse amplifier 116 which is shown in FIG. 8B as comprising two interconnected transistors. Amplifier 116 also receives a control signal by way of line 144 from ROM-6. If line 144 is grounded then there is no pulse amplification and the pulse signal on terminal 142 is coupled by way of diode X, line 156 and resistor 145 to pulse line 140 (FIG. 8A) and from there to the summer 136.

The output of summer 136 couples by way of line 146 to the high pass filters 122 which comprise four separate filter circuits each including a series connected capacitor and resistor. Each of these filter circuits includes a control signal coupled on lines 147, 148, and 149, and 150 from ROM-6. By selectively grounding one or more of these lines different filter characteristics can be provided by the high pass filters 122. The output of filters 122 couples by way of line 152 to the audio input 154 of the voltage controlled filter 124.

The output of amplifier 116, which has been previously mentioned as connecting to summer 136 by way of resistor 145, also couples by way of interconnecting line 156 to resonators A, B and C. Each of these resonators is of substantially the same construction and each includes a bridged-T network including operational amplifier 158. Resonator A has two modes of operation, resonator B three modes of operation and resonator C five modes of operation. The resonators provide programmed frequency response control for the pulse signal. Because each of the resonators are of substantially similar design, and because they are not considered as being novel in themselves, the discussion is limited to the structure of resonator A.

As previously indicated, resonator A includes an operational amplifier 158 which has one input 159 referenced to near ground and its other input 160 coupled by way of resistors 161 and capacitor 162 to line 156. The output of operational amplifier 158 is controlled by selection logic 128, and when this logic permits an output from operational amplifier 158 it is coupled to output line 164 which ties to common interconnect line 183 which in turn connects to resonators B and C.

The operational amplifier 158 of resonator A includes output filter circuits 167 and 168 each of which connects across the operational amplifier 158 from input to output. Control signals are provided from selection logic 128, which is in turn controlled from ROM-7, for coupling either or both of the filter circuits 167 or 168 across amplifier 158. The filter networks 167 and 168 are of conventional design and are termed bridged-T networks. They are active band-pass filters.

Resonator B also includes an operational amplifier 158 and three filter circuits 170, 171, and 172 which are also selectively controlled from selection logic 128.

Resonator C includes an operational amplifier 158 and five filter circuits 175, 176, 177, 178, and 179. There are in effect, two outputs from resonator C. One output couples by way of resistor 180 and line 181 to the input of voltage controlled amplifier 129. The output also couples to the tie line 183.

The other output from resonator C is coupled by way of resistor 185 and line 152 to the audio input of voltage control filter 124. This input is combined with the output from filters 122, as previously shown in FIG. 7.

The outputs from the resonator C which couple by way of resistors 180 and 185 can be controlled by way of the signals fed on lines 190 and 191. The lines 190 and 191 couple from ROM-7 and are designated as the resonator C to VCF and resonator C to VCA signals. If either of these lines are grounded the associated output is blocked and not coupled to either the voltage control amplifier or voltage control filter.

FIG. 8A also shows the tracking attenuator 132 which comprises three transistors and has inputs connected from ROM-5. Different degrees of filter tracking can be provided depending upon which of the outputs from ROM-5 are grounded. In the disclosed embodiment a one volt per octave, a two volt per octave, a five volt per octave, or a no-tracking condition can be provided with the circuitry shown.

The ROM-5 also includes control outputs that couple to the resonance circuit 204 by way of buffers 206. The resonance circuit comprises three separate sections for providing minimum resonance, medium resonance and maximum resonance. These circuits couple to the resonance input 202 of the voltage controlled filter 124. When the WOW input line is high circuit 204 operates at maximum resonance.

ROM-5 also typically includes filter offset control which couples to the control input of the voltage control filter.

The output of the voltage controlled amplifier couples to the power amplifier box shown in FIG. 1 and may couple by way of a volume control means.

Thus, in FIGS. 8A and 8B the pulse and sawtooth waveforms are operated upon and pass to the voltage controlled filter and/or voltage controlled amplifier. The signals from the envelope generators are used for dynamic control of the spectrum and amplitude of the audio signal.

What is claimed is:

1. An electronic musical system having a keyboard and comprising:

means coupled to said keyboard and responsive to operation of at least one key of said keyboard for providing a signal of frequency corresponding to the key played, means responsive to the playing of at least one key for providing a control signal, an analog signal generator including resistance-capacitance time-constant elements for controlling the shape of an audio waveform and responsive to said frequency signal and said control signal for generating said waveform, and digital code storage means coupled to both said frequency signal providing means and said control signal providing means for controlling their signals.

2. The system of claim 1 wherein said frequency signal providing means includes a pulse waveform generator and a sawtooth waveform generator.

3. The system of claim 2 including means for combining said pulse and sawtooth waveforms.

4. The system of claim 2 including pulse width selection logic response to said code storage means for providing different possible pulse widths for said pulse waveform.

5. The system of claim 1 wherein said code storage means controls the frequency of said frequency signal.

6. The system of claim 5 wherein said control changes said frequency by an octave.

7. The system of claim 1 wherein said frequency signal and control signal providing means are coupled from said keyboard by way of keyboard circuitry.

8. The system of claim 7 wherein said keyboard circuitry includes means responsive to said played key for generating a binary code corresponding thereto.

9. The system of claim 8 wherein said keyboard circuitry includes means for sequentially interrogating said keys to determine if one has been played, and for storing the binary code corresponding to the played key.

10. The system of claim 1 wherein said control signal providing means includes at least one envelope generator having attack circuit means and release circuit means.

11. The system of claim 10 including a pair of envelope generators.

12. The system of claim 11 wherein said code storage means controls said attack circuit means and release circuit means.

13. The system of claim 1 wherein said code storage means is coupled to read only memories in said frequency signal providing means and said control signal providing means.

14. The system of claim 1 wherein said means for generating includes voltage controlled filter means and voltage control amplifier means.

15. The system of claim 14 including resonator means for receiving a pulse waveform and coupled to filter means.

16. The system of claim 15 wherein said code storage means controls the filter means of said resonator means.

* * * * *